United States Patent [19]

Hudson

[11] Patent Number: 4,841,745

[45] Date of Patent: Jun. 27, 1989

[54] EARRING DEVICE, AND METHODS OF CONSTRUCTING AND UTILIZING SAME

[76] Inventor: David S. Hudson, 349 E. Maplehurst, Ferndale, Mich. 48220

[21] Appl. No.: 50,085

[22] Filed: May 15, 1987

[51] Int. Cl.[4] ..... A44C 7/00

[52] U.S. Cl. ..... 63/12; D11/73

[58] Field of Search ..... 63/12, 13; D11/73, 42, D11/40, 41, 14, 77, 78, 75

[56] References Cited

U.S. PATENT DOCUMENTS

| | | | |
|---|---|---|---|
| 260,692 | 7/1882 | Krementz | 63/12 |
| D. 292,780 | 11/1987 | Galask | D11/48 |
| 3,945,089 | 3/1976 | Gagnon | 63/12 |
| 4,148,199 | 4/1979 | Boykin | 63/12 |
| 4,307,582 | 12/1981 | Mancini | 63/12 |
| 4,353,225 | 10/1982 | Rogers | 63/13 |
| 4,468,936 | 9/1984 | Kirk et al. | 63/12 |
| 4,543,804 | 10/1985 | Cappiello | 63/12 |
| 4,630,452 | 12/1986 | Connelly | 63/12 |

FOREIGN PATENT DOCUMENTS

| | | | |
|---|---|---|---|
| 40085 | 10/1909 | Austria | 63/12 |
| 3876 | of 1872 | United Kingdom | 63/12 |

*Primary Examiner*—Richard J. Johnson

*Attorney, Agent, or Firm*—Irving M. Weiner; Pamela S. Burt; Roland W. Norris

[57] ABSTRACT

An earring device including two interlockable, elongated portions. When worn by the wearer, the device gives the appearance of a tapered structure spiked through the wearer's earlobe.

14 Claims, 2 Drawing Sheets

EARRING DEVICE, AND METHODS OF CONSTRUCTING AND UTILIZING SAME

BACKGROUND OF THE INVENTION

1. Field of the Invention

The present invention relates generally to earrings, and particularly to elongated, tapered earrings. When worn in the wearer's earlobe, the earring gives the appearance of a one-pieced earring spiked therethrough.

2. Description of the Relevant Art

The relevant art is exemplified by: Boykin U.S. Pat. No. 4,148,199 entitled "PIERCED EARRING WITH LIQUID VISIBLE THEREIN"; Mancini U.S. Pat. No. 4,307,582 entitled "HOLLOW, FLANGED EARRING POST CONSTRUCTION"; Kirk et al U.S. Pat. No. 4,468,936 entitled "EARRING EARFITTING WITH PRIMARY AND SECONDARY LOCKING MEANS"; and Cappiello U.S. Pat. No. 4,543,804 entitled "PIERCED EARRING LOCKING AND HOLDING SYSTEM".

The present invention includes features not taught or suggested by the relevant art. These features provide a modification of earring posts which are easily fastened and removed, and are inexpensive to produce. Furthermore, relatively complex earring fastenings (Boykin, for example) are difficult to clean, and hence are hygienically undesirable.

SUMMARY OF THE INVENTION

The present invention provides an ornamental earring comprising a male portion and a female portion. The male portion includes a body part formed in the shape of half an elongated earring structure which has an earring post for fitting through the pierced earlobe of the wearer. The female portion includes a body part formed in the shape of half of an elongated earring structure which has an earring post receiving part for removably receiving and holding the earring post. When the male and female portions are interlocked with one another while worn on the wearer's ear, the appearance of a tapered elongated structure spiked through the wearer's earlobe is created.

An object of the present invention is to provide an earring device as described hereinabove which is comprised of a minimum number of parts, thereby allowing for inexpensive manufacture.

Another object of the invention is to provide a device as described which is comprised of components which are inexpensive to manufacture and which are created of readily available materials.

A further object of the invention is to provide a device as described which is easily cleaned and disinfected, thereby allowing for the easy maintenance of proper hygiene.

Yet another object of the invention is to provide such a device which is lightweight, thereby posing minimum discomfort to the wearer.

Still a further object of the present invention is to provide such a device wherein the male and female portions are easily interlocked and separated.

Yet another object of the present invention is to provide such a device wherein the male and female portions are securely interlocked when worn by the wearer.

Still another object of the present invention is to provide such a device which accommodates fashionable earring designs of many variations while still utilizing the basic interlocking designs disclosed herein.

The above and further objects, features and advantages of the present invention will become apparent from the following detailed description of the preferred embodiments of the invention, when read in conjunction with the accompanying drawings.

DETAILED DESCRIPTION OF THE PREFERRED EMBODIMENTS

The earring device according to this invention is presented in a variety of embodiments, each having in common two portions, a male portion having an earring post, and a female portion having an earring post receptacle. The male and female portions, when interlocked, preferably, but not exclusively, combine to form an elongated earring device having a slight taper caused by a reduction of dimension from the end of the female portion to the opposite end of the male portion. Nevertheless, it is to be understood that many variations of the body of the earring device may be made according to the present invention. Preferably, but not exclusively, the earring post is made of a precious metal. The male and female portions may be of a variety of materials, including plastic, and may be of a variety of colors.

Figure 1:
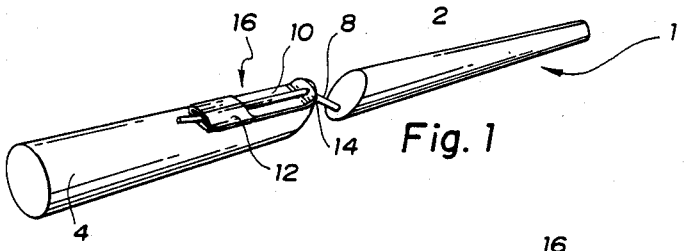
FIG. 1 illustrates a perspective view showing a preferred embodiment of the earring device.
Figure 2:
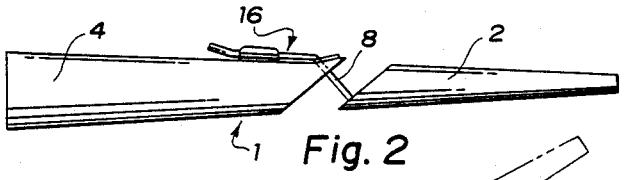
FIG. 2 illustrates a side elevational view of the device of FIG. 1.
Figure 3:
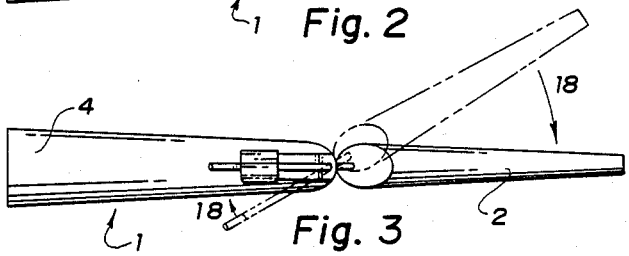
FIG. 3 illustrates a top elevational view of the device of FIG. 1 showing the male portion in both the locked and unlocked positions with respect to the female portion.

With reference to FIGS. 1–3, there is described a preferred embodiment of the present invention.

There is shown an earring device generally indicated as 1, having a male portion 2 and a female portion 4. As illustrated, device 1 has an elongated conical shape embodying a gentle taper from the end of female portion 4 to the opposite end of male portion 2, although it is envisioned that device 1 may be of a variety of shapes and designs (see, e.g., FIGS. 9 and 10). Male portion 2 is preferably provided with a substantially elongated, angularly bent post 8 for removably interlocking with the post receiving element of female portion 4, generally indicated as 16. Post-receiving element 16 is preferably, but not exclusively, comprised of substantially planar base plate 10 provided at one end with a post-receiving aperture 14, and fitted further with a clamping plate 12 communicating on at least one side with base plate 10.

In use, and referring particularly to FIG. 3, post 8 of male portion 2 is placed through the pierced earlobe of the wearer. Thereafter, post 8 is fitted through aperture 14 of post receiving part 16 of female portion 4. Post 8 is next removably locked into place between clamping plate 12 and base plate 10 by a pivotal motion generally indicated by direction arrows 18. Removal is accomplished by reversing this procedure.

Figure 4:
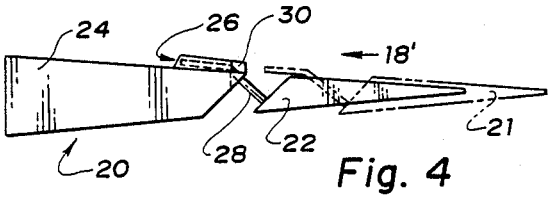
FIG. 4 illustrates a side elevational view of another embodiment of the earring device showing the male portion in both the locked and unlocked positions with respect to the female portion.
Figure 5:
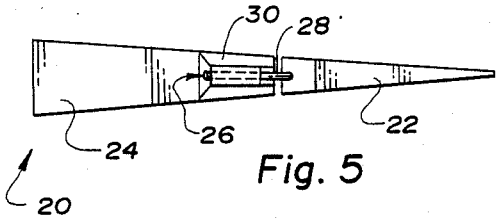
FIG. 5 illustrates a top view of the device of FIG. 4 in its locked position.

Referring now to FIGS. 4 and 5, there is described another preferred embodiment of the present invention.

There is shown an earring device generally indicated as 20 having a male portion 22 and a female portion 24. As illustrated, device 20 has an elongated, multiple-sided shape embodying a gentle taper from the end of female portion 24 to the opposite end of male portion 22, although it is envisioned that device 20 may be of a variety of shapes and designs (see, e.g., FIGS. 9 and 10).

Male portion 22 is preferably provided with a substantially elongated, angularly bent post 28 for removably interlocking male portion 22 with the post receiving element of female portion 24, generally indicated as 30. Post receiving element 30 is an integral raised element of female portion 24 having a post receiving aperture 26 provided therethrough.

In use, and referring particularly to FIG. 4, post 28 is placed through the pierced earlobe of the wearer. Thereafter, post 28 is moved from the unlocked position generally indicated by 21 in a direction generally indicated by direction 18' into aperture 26 of female portion 24. Post 28 is lockingly held by friction between female portion 24 and post 28. Removal is accomplished by reversing this procedure.

Figure 6:
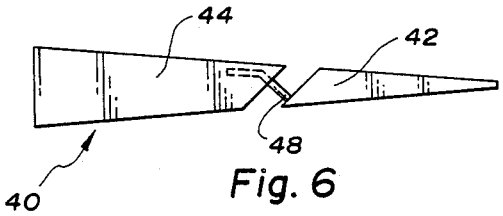
FIG. 6 illustrates yet another embodiment of the earring device.
Figure 7:
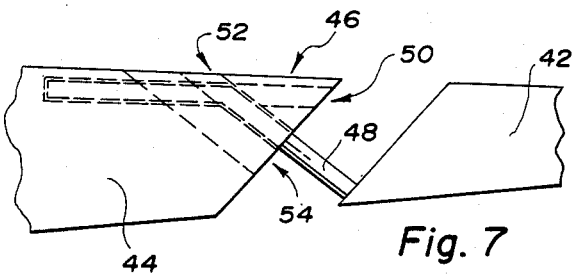
FIG. 7 illustrates a partial, sectional side elevational view of the embodiment of FIG. 6.
Figure 8:
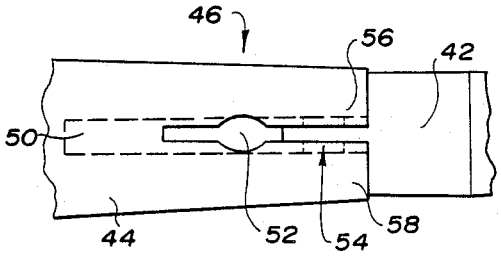
FIG. 8 illustrates a partial, sectional top view of the embodiment of FIG. 6.

Referring now to FIGS. 6–8, there is described yet another preferred embodiment of the present invention.

There is shown an earring device generally indicated as 40 having a male portion 42 and a female portion 44. As illustrated, and like the previous embodiment, device 40 has an elongated, multiple-sided shape embodying a gentle taper from the end of female portion 44 to the opposite end of male portion 42, although it is envisioned that device 40 may be of a variety of shapes and designs (see FIGS. 9 and 10).

Male portion 42 is preferably provided with a substantially elongated, angularly bent post 48 for removably interlocking male portion 48 with the post-receiving part of the female portion, generally indicated as 46 in FIGS. 7 and 8.

Post receiving part 46 is comprised of post receiving aperture 50 shown by shadow lines and provided along the longitudinal axis of female portion 44, diagonal post holding aperture 52 shown by shadow lines, and slotted portion 54, also shown by shadow lines.

In use, and still referring particularly to FIGS. 7 and 8, post 48 is placed through the pierced earlobe of the wearer. Thereafter, post 48 is fitted through slotted portion 54. The two halves 56 and 58 separate slightly to allow passage of post 48 therethrough into receiving aperture 50. When post 48 is entered into receiving aperture 50, post 48 is snap-fitted into its held position by diagonal post holding aperture 52 and by sides 56 and 58. Removal is accomplished by reversing this procedure.

Figure 9:
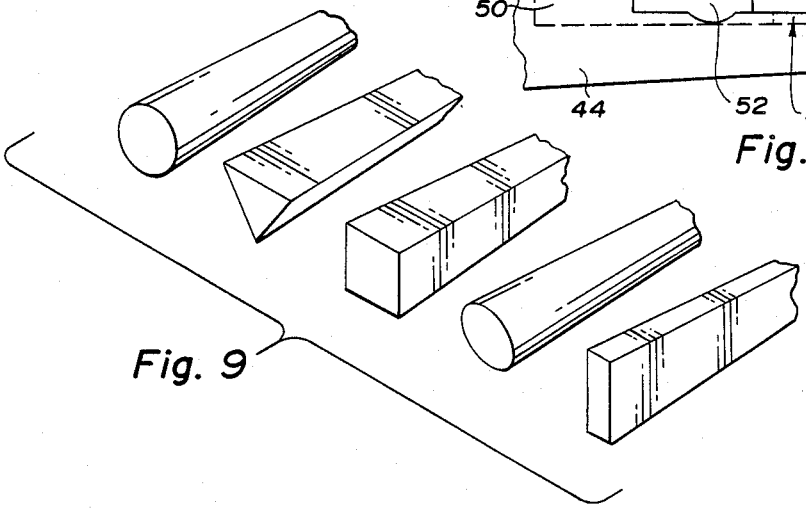
FIG. 9 illustrates a variety of possible shapes of the body portion of the earring device.

As suggested, the shapes of the earring device according to this invention are not limited to the shapes described hereinabove, but may embody a variety of shapes and styles as partially indicated in FIG. 9 by way of example, and not limitation.

Figure 10:
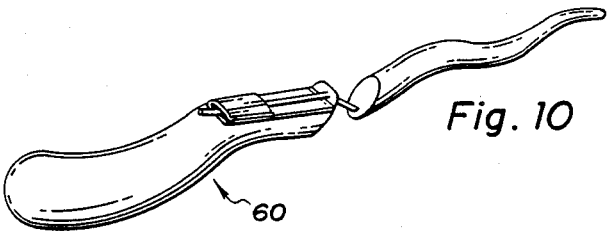
FIG. 10 illustrates an alternate body shape of the earring device.

Additionally, the shapes need not be substantially straight, but may be of an undulated design as illustrated by FIG. 10.

While the present invention has been illustrated and described in connection with preferred embodiments, it is not to be limited to the particular structures shown, because many variations thereof will be evident to one skilled in the art and are intended to be encompassed in the present invention set forth in the following claims.

I claim:

1. An ornamental earring, comprising: a male portion including a body part formed in the shape of half an elongated earring structure having a first end and an earring post which is adapted to be fitted through a pierced earlobe of a wearer;

a female portion including a body part formed in the shape of another half of said elongated earring structure and having a second end and an earring post-receiving part for slidably receiving and holding said post;

said male and female portions, when interlocked with one another while worn by said wearer, giving an overall appearance of a tapered elongated structure spiked through said wearers earlobe;

said male portion has a post end opposite said first end, said post end being substantially planar and being disposed oblique to the longitudinal axis of said male portion;

said female portion has a post receiving end opposite said second end, said post-receiving end being substantially planar and being disposed oblique to the longitudinal axis of said female portion; and said substantially planar post end and said substantially planar post-receiving end being disposed substantially parallel to each other with said earlobe placed therebetween when said ornamental earring is worn by said wearer.

2. An ornamental earring according to claim 2, wherein:

said earring post-receiving part is comprised of an aperture extending from said planar post-receiving end which is substantially parallel to the longitudinal axis of said female portion and a longitudinal slit extending from said planar post-receiving end and communicating with an outer surface of said female portion and said aperture.

3. An ornamental earring comprising:

a male portion including a body part formed in the shape of half an elongated earring structure having a first end and an earring post extending substantially parallel to the longitudinal axis of said male portion which is adapted to be fitted through a pierced earlobe of a wearer;

a female portion including a body part formed in the shape of another half of said elongated earring structure and having a second end and an earring post-receiving part for slidably receiving and holding said post; and said male and female portions, when interlocked with one another while worn by said wearer, giving an overall appearance of a tapered elongated structure spiked through said wearer's earlobe; and said earring post-receiving part is an integral raised elevation of said female portion provided at the end of said female portion opposite said second end and having provided therethrough an aperture the bore of which is substantially parallel to the longitudinal axis of said female portion.

4. An ornamental earring comprisiing: a male portion including a body formed in the shape of half an elongated earring structure having a first end and an earring post which is adapted to be fitted through a pierced earlobe of wearer;

a female portion including a body part formed in the shape of another half of said elongated earring structure having a second end and an earring post-receiving part for slidably receiving and holding said post;

said male and female portions, when interlocked with one another while worn by the user, giving the appearance of an elongated structure driven through said wearer's earlobe; and said first end being of a reduced dimension relative to said second end, thereby providing said elongated structure with a tapered appearance;

said male portion has a post end opposite said first end, said post end being substantially planar and being disposed oblique to the longitudinal axis of said male portion;

said female portion has a post receiving end opposite said second end, said post receiving end being substantially planar and being disposed oblique to the longitudinal axis of said female portion; and said substantially planar post end and receiving end being disposed substantially parallel to each other with said earlobe place therebetween when said ornamental earring is worn by said wearer.

5. An ornamental earring according to claim 4, wherein:

said earring post-receiving part is comprised of an aperture extending from said planar post-receiving end which is substantially parallel to the longitudinal axis of said female portion and a longitudinal slit extending from said planar post-receiving end and communicating with an outer surface of said female portion and said aperture.

6. An ornamental earring, comprising:

a male portion including a body part formed in the shape of half an elongated earring structure having a first end and an earring post extending substantially parallel to the longitudinal axis of said male portion which is adapted to be fitted through a pierced earlobe of a wearer;

a female portion including a body part formed in the shape of another half of said elongated earring structure and having a second end and an earring post-receiving part for slidably receiving and holding said post;

said male and female portions, when interlocked with one another while worn by the user, giving the appearance of an elongated structure driven through said wearer's earlobe; and said first end being of a reduced dimension relative to said second end, thereby providing said elongated structure with a tapered appearance; and said earring post is substantially elongated and is provided with a plurality of angular bends so that it may be received and held by said earring post-receiving part.

7. An ornamental earring according to claim 6, wherein:

said earring post-receiving part is comprised of a substantially planar base plate having a post support aperture and a clamping plate communicating with said base plate.

8. An ornamental earring according to claim 11, wherein;

said earring post receiving part is an integral raised elevation of said female portion provided at the end of said female portion opposite said second end and having provided therethrough an aperture the bore of which is substantially parallel to the longitudinal axis of said female portion.

9. An ornamental earring, comprising:

a male portion having a major longitudinal axis and including a body part formed in the shape of half an elongated earring structure having a first end and an earring post having an angular bend which is adapted to be fitted through a pierced earlobe of a wearer;

a female portion having a major longitudinal axis and including a body part formed in the shape of another half of said elongated earring structure having a second end and an earring post-receiving part for slidably receiving and holding said post;

said male and female portions, when interlocked with one another while worn by said wearer, placing said major longitudinal axis of said male part in substantially collinear alignment with said major longitudinal axis of said female part, giving an overall appearance of an elongated structure spiked through the wearer's earlobe at an oblique angle with respect to the major longitudinal axis of the wearer; and said first end having a reduced dimension relative to said second end, thereby providing said elongated structure with a tapered appearance.

10. An ornamental earring according to claim 9, wherein:

said earring post is substantially elongated and is provided with a plurality of angular bends so that it may be received and held by said earring post-receiving part.

11. An ornamental earring according to claim 9, wherein:

said earring post-receiving part is comprised of a substantially planar base plate having a post support aperture and a clamping plate communicating with said base plate.

12. An ornamental earring according to claim 9, wherein:

said earring post-receiving part is an integral raised elevation of said female portion provided at the end of said female portion opposite said second end and having provided therethrough an aperture substantially parallel to the longitudinal axis of said female portion.

13. An ornamental earring, comprising:

a male portion including a body part formed in the shape of half an elongated earring structure having a first end and an earring post which is adapted tc be fitted through a pierced earlobe of a wearer;

a female portion including a body part formed in the shape of another half of said elongated earring structure having a second end and an earring post-receiving part for slidably receiving and holding said post;

said male and female portions, when interlocked with one another while worn by said wearer, giving an overall appearance of an elongated structure spiked through the wearer's earlobe at an oblique angle with said second end extending downward and toward the base of the wearer's neck and said first end extending upward and away from said wearer's neck; and said first end having a reduced dimension relative to said second end, thereby providing said elongated structure with a tapered appearance;

said male portion has a post end opposite said first end, said post end being substantially planar and being disposed oblique to the longitudinal axis of said male portion;

said female portion has a post-receiving end opposite said second end, said post-receiving end being substantially planar and being disposed oblique to the longitudinal axis of said female portion; and said substantially planar post end and said substantially planar post-receiving end being disposed substantially parallel to each other with the earlobe placed therebetween when said ornamental earing is worn by said wearer.

14. An ornamental earring according to claim 13, wherein:

said earring post receiving part is comprised of an aperture extending from said planar post-receiving end which is substantially parallel to the longitudinal axis of said female portion and a longitudinal slit extending from said planar post-receiving end and communicating with an outer surface of said female portion and said aperture.

* * * * *

UNITED STATES PATENT AND TRADEMARK OFFICE

CERTIFICATE OF CORRECTION

PATENT NO. : 4,841,745

DATED : June 27, 1989

INVENTOR(S) : David Hudson

It is certified that error appears in the above-identified patent and that said Letters Patent is hereby corrected as shown below:

Column 4, line 40 (Claim 2, line 1), change "2" to --1--.

Column 5, line 3 (Claim 4, line 1), correct the spelling of "comprising".

Column 6, line 3 (Claim 8, line 1), change "11" to --6--.

Signed and Sealed this

Twenty-fourth Day of July, 1990

*Attest:*

HARRY F. MANBECK, JR.

*Attesting Officer*

*Commissioner of Patents and Trademarks*